US005085062A

United States Patent [19]

Capdevila

[11] Patent Number: 5,085,062

[45] Date of Patent: Feb. 4, 1992

[54] KEYS AND RELATED MAGNETIC LOCKS TO CONTROL ACCESSES

[75] Inventor: Juan Capdevila, Ctra. de Torelló, s/n. 08572 Sant Pere De Torelló, Barcelona, Spain

[73] Assignee: Juan Capdevila, Barcelona, Spain

[21] Appl. No.: 413,110

[22] Filed: Sep. 27, 1989

[30] Foreign Application Priority Data

Sep. 28, 1988 [ES] Spain ..... 8802942
Feb. 22, 1989 [ES] Spain ..... 8900650

[51] Int. Cl.[5] ..... E05B 47/00
[52] U.S. Cl. ..... 70/276; 70/413
[58] Field of Search ..... 70/413, 276, 277, 395

[56] References Cited

U.S. PATENT DOCUMENTS 4,317,156 2/1982 Stangl ..... 70/413
4,712,398 12/1987 Clarkson ..... 70/276
4,788,623 11/1988 Haug ..... 70/413
4,848,115 7/1989 Clarkson ..... 70/276

FOREIGN PATENT DOCUMENTS 0117798 5/1984 European Pat. Off. .
0129042 10/1984 European Pat. Off. .
2262571 9/1975 France .
2388110 11/1978 France .
2009303 10/1978 United Kingdom .

*Primary Examiner*—Robert L. Wolfe
*Attorney, Agent, or Firm*—Banner, Birch, McKie & Beckett

[57] ABSTRACT

A key composed of a body with recesses which can be filled with magnetized disks, arranged in a combination of norths and/or souths and/or lack thereof, and with a sliding lid holding the magnetic disks in the recesses. The lock has one or two sets of magnetic sensors geometrically ordered according to the refillable recesses. When the key is placed adjacent to the series of magnetic lock sensors, the sensors detect the magnetized disks, pass the detected signal to a conventional converter-codifier circuit that generates a code that is sent, by cable or radio, to a station which interprets the code and, if correct, allows access.

11 Claims, 3 Drawing Sheets

FIG.1
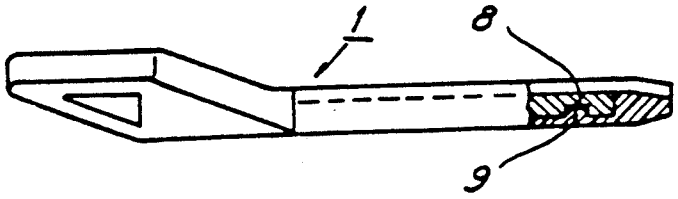
FIG.3
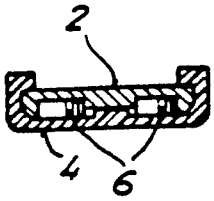
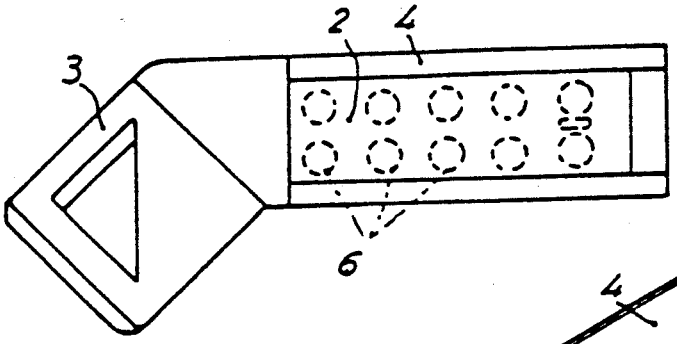
FIG.2
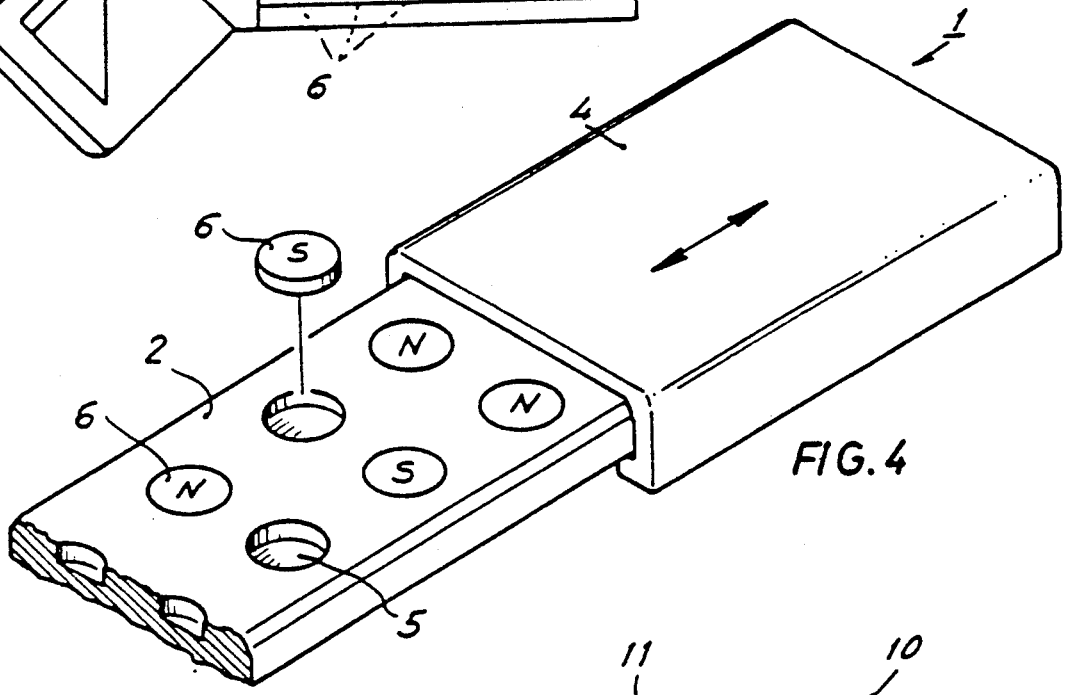
FIG.4
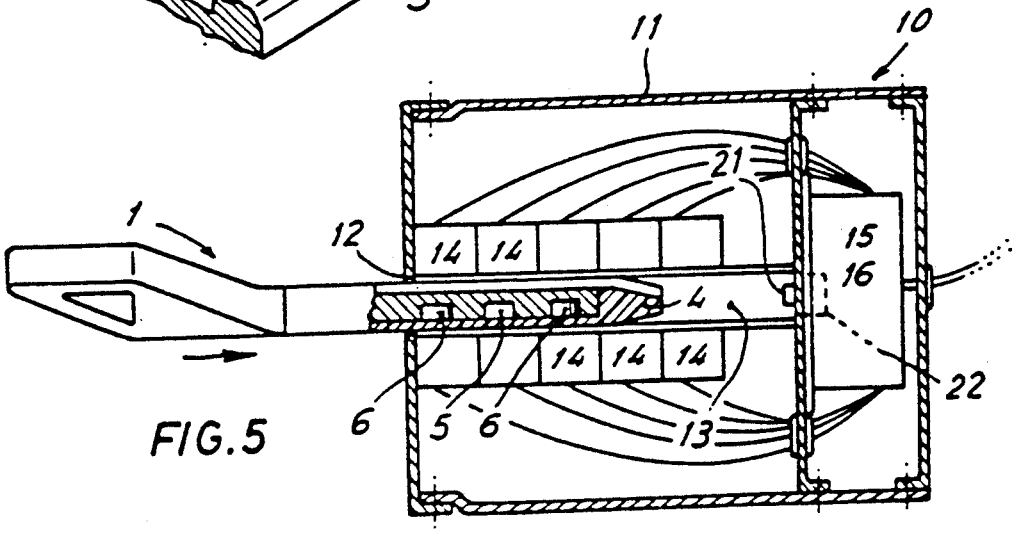
FIG.5

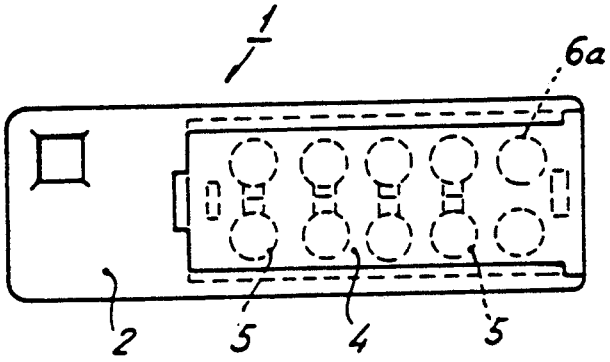
FIG. 7
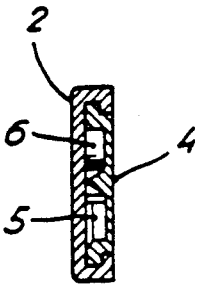
FIG. 8
FIG. 9
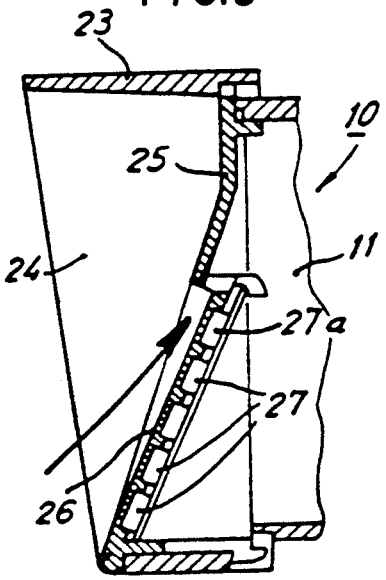
FIG. 10
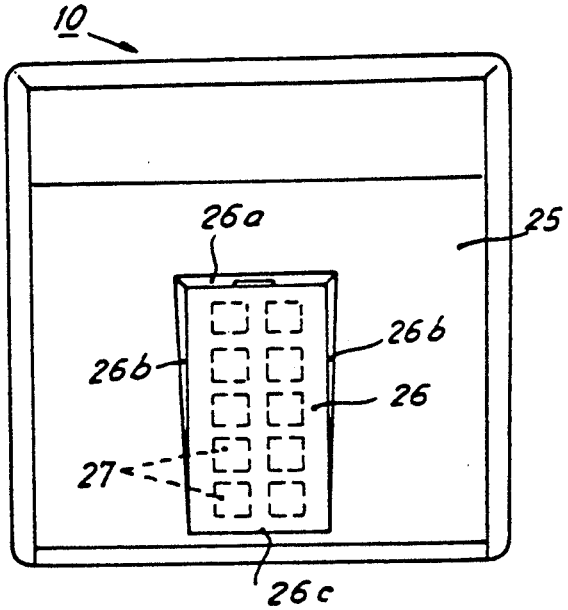

KEYS AND RELATED MAGNETIC LOCKS TO CONTROL ACCESSES

The present invention is directed to improvements in keys and related locks applicable to, for example, garage, office, store, elevator doors, or alarm activation/-deactivation environments, where the introduction of a key in a lock provides a digital signal related to a combination of magnetic poles that an electronic station can test and in the event the signal is appropriate, executes a certain function.

Keys, known for such purpose, have a bit constituted by two plates, welded together with small build-in disks. First the disks are in virgin state, i.e., they possess no magnetic polarity at all. When the keys are delivered to users, the disks are magnetized with special apparatuses.

Depending on the amount of disks contained in the key, and according to the combinatory theory, many hundreds of combinations can be obtained. Obviously, all the keys designed for a same lock, for example, for condominium users, would contain same combination. On its side, the lock contains a series of pivots that can only move (by magnetic repulsion) by means of a defined key combination; should the combination be the right one, the key can be introduced up to the back of the lock in whose moment it establishes the electrical contact that will activate the related apparatus. It can be said then that it is a magneto-mechanical system.

These systems have a drawback: when the key disappears, because of lost or robbery, the lock combination must be changed by the manufacturer or a specialized workshop or completely replaced. Even more of a drawback, following the lock change or replacement, all users' keys must be collected and replaced by new ones because the users cannot vary the magnetic combination of the keys. With the key and lock, according to the present invention, these inconveniences are overcome.

According to the present invention, the key bit presents two superposed parts: one part provides a lid and slides lengthwise to cover or uncover the second part. The second part contains several rows of recesses capable of being filled with previously magnetized disks. Even more, the recesses can be left unfilled. Thus there are three possibilities arising for each recess: a North-South polarity, a South-North polarity or no polarity at all resulting from no magnetized disk. Thus the number of possible combinations for the whole key set increases significantly.

The most important point is that when a key is lost, users of a same condominium can easily change the magnetic combination of theri related key, but simply opening the lid of same, giving half-turn to all or some of the magnetized disks, emptying some recess of refilling other empty recesses with related disk. Consequently, no new keys need to be provided nor will it be necessary to have available a special apparatus to magnetize them. Obviously, the user or the person in charge of the premise will have to intervene, who will only have to move some switches that form the code in the electronical station in order it is sensible to the new magnetic combination.

The lock, according to the present invention, consists of a case with an input slot for the key, and an inner part having a set of magnetic sensors corresponding to the recesses of the key and on one or both sides of the slot.

The sensors, for example, Hall effect, magneto-resistive, or based on any other magneto-electronic effect, generate a ternary code when facing appropriate recess and side of the key. The ternary code is picked up by a codifier. The sensors and codifier are located in the lock. Digital information or code is transmitted, via cable or radio, to the electronic station that decodifies the signal and compares it with a pre-established code. Should both codes coincide, a relay will be activated that will electrically drive the member which is to accomplish the desired function in the door, alarm, etc.

It is understood that by changing the code of the electronic station, the standard combination can easily be changed, contrary to known mechano-electrical locks mentioned above, in which to vary the combination it would be necessary to change the internal combination, or which is the same, to replace the lock.

On the other hand, it must be pointed out that, while the magneto-mechanical locks could be forced open by some mechanical device, the lock according to the present invention is inviolable, because it only responds to the magnetic effects and is electronically operated. To simplify all above, the use of a certain type of sensor enables the use of a set of sensors on a single side of the lock slot; this makes it possible to omit the other side of the slot, converting it into a plane on which the user applies the key. The benefits are many and multiple: the lock cost is decreased because fewer sensors are needed and a simpler circuit is required; mechanical construction is simplified; the user's application is speedier as he has only to apply or slide his key on the plane; and foreign objects cannot become lodged in a slot since no slot exists.

In order to make the explanation easier, the attached drawings illustrate a representative practical embodiment.

BRIEF DESCRIPTION OF THE DRAWINGS

FIGS. 1 and 2 are respective elevation view and ground plan of the key according to the present invention.

FIG. 3 corresponds to a cross section of FIG. 1.

FIG. 4 shows a part perspective view of a key in the reverse position of FIG. 2.

FIG. 5 corresponds to a section of an elevation view of a key as it is introduced in a related lock.

FIG. 7 is an elevation view of a second embodiment of a key.

FIG. 8 corresponds to a cross section of FIG. 7.

FIG. 9 represents a cross section elevation view of a lock corresponding to the second key embodiment showing the location where the key is applied with an arrow.

FIG. 10 illustrates a front view of the second lock embodiment.

Figure 6:
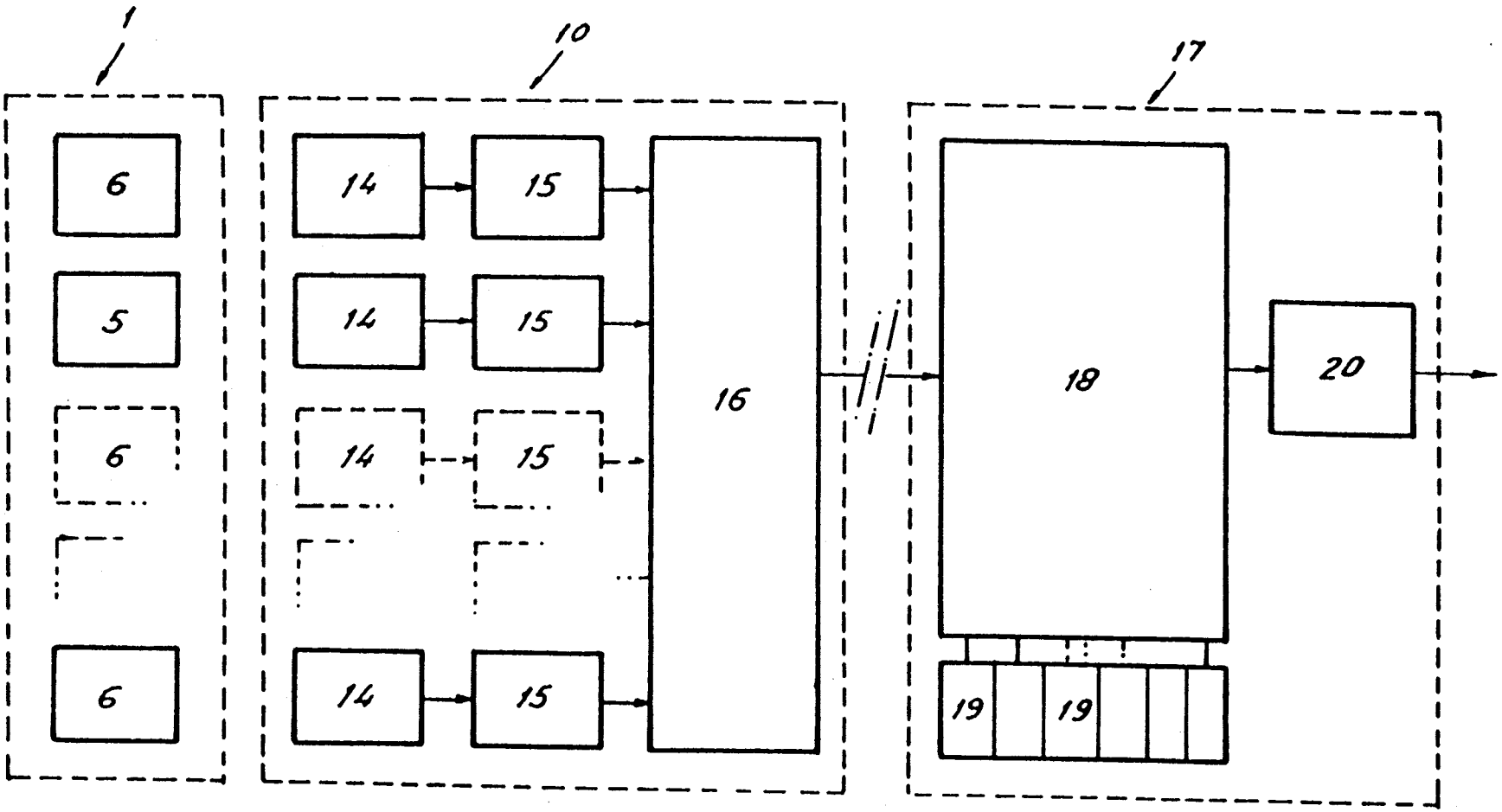
FIG. 6 shows a diagram by blocks of a key, lock and station.

Referring to the FIGS. (1 to 6), the key 1 is composed of body 2 linked to ring 3 and lid 4. The body, or bit, 2 has a set of recesses 5, that could be cylindrical, fillable by respective magnetic disks 6, showing either its North or South face toward one side of the bit 2 or can be left unfilled. The lid 4 has a section, essentially C-shaped in order to be able to slide lengthwise on the bit, tightly covering the disks 6 in order that they do not fall out. To secure and stabilize the closed position of the lid 4, a groove 8 and an offset 9 couple together. On its side, lock 10 includes case 11 with slot 12 and internal canal 13 adapted to receive key 1.

At each of the sides of canal 13 there are arranged magnetic sensors 14 corresponding to the recesses 5 of key 1. Sensors 14, that could be based in the Hall effect or any other known effect of magnetic reading, generate a signal that is converted from analog to digital in 15 and codified by 16 in a ternary digital electronic signal using conventional components and circuitry. This code is transmitted either by cable or radio, and received in electronical station 17 where it is decodified by 18 and compared with the pre-established combination in ternary microswitches 18. If the code coincides with the pre-established combination, relay 20 is activated that will drive a member operating a door, access, alarm etc. (not shown).

As already mentioned, the combination can be varied whenever it is convenient, in order to respond with a new combination of disks 6 and recesses 5 in key 1 in the event of robbery or if the key is lost.

At the bottom of canal 13 microswitch 22 is intercalated in the circuit feeding of the lock 10 (not shown and of a known type). The moving part 21 of microswitch 22 emerges in such a way that when key 1 is fully inserted its point pushes the microswitch 22 and the referred to circuit is closed.

According to FIG. 7, key 1 is formed by body 2 and lid 4, but with the recesses 5 in the lid 4 filled, in this case, by magnets 6 (FIG. 8). This modification does not excessively weaken the thickness of the body 2.

The lock 10 whose front part of the case 11 (FIGS. 9 and 10) is opened forming a clearance similar to an eye-shade-like shelter 23 with sides 24, containing an inclined plate 25. In a portion of plate 25 there exists a less steeply inclined and partially recessed fixed plane 2. On the back side of plane 26, i.e., inside lock 10, are incorporated magnetic sensors 27 corresponding to as many magnets 6 in recesses 5 in key 1 and with same geometrical distribution.

Sensors 27 will be specially of the type that each by itself is able to recognize whether the face of related magnet in front of it corresponds to a South or North pole and to detect the absence of a magnet for the case of an empty recess, without requiring other additional sensors to realize such identifications or acknowledgements. Thus, it is viable to use magnetic sensors 27 for a single face of key 1.

Obviously to operate lock 10 it will be enough to apply the key 1 on plane 26. Obviously, the recessed portion of plane 26 is in order that the key is against the upper part 26*a* and in order that it remains correctly located between the sides 26*b*; the lower part 26*c* of the plane 26, level with its own plate 25. It is to make the application of key 1 easier by sliding it upward.

Just as for the key of FIG. 4, the magnets 6 are removable and orientable within the recesses 5 to create a great variety of combinations of Norths, Souths and lack thereof for respective locks of doors or different alarms facilities. In FIG. 7, one of the magnets 6*a* is fixed and reserved in order that, when related sensor 27*a* (FIG. 9) detects it, the proper part of the codifier circuit 15, 16 is connected or started.

The invention may be embodied in other specific forms without departing from the spirit or essential characteristics thereof. The present embodiments are therefore to be considered in all respects as illustrative and not restrictive, the scope of the invention being indicated by the appended claims rather than be the foregoing description, and all changes which come within the meaning and range of equivalency of the claims are therefore intended to be embraced therein.

I claim:

1. In a magnetic locking system having keys and related magnetic locks, including a codifier circuit with a coded output signal transmitted to an electronic station that decodes and compares the output signal with a predetermined combination and actuates a means for releasing the related magnetic lock if the decoded output signal equals the combination, the improvement comprising a key comprising a bit with at least one recess arranged into at least one row of recesses, the at least one recess oriented transversely to the longitudinal axis of the key and capable being filled with a removable magnetized disk, the magnetized disk oriented in either magnetic polarity along the longitudinal axis of the at least one recess, the two possible orientations of the magnetic field of the magnetized disk and the possibility of an absence of a magnetic field if the at least one recess is empty forming a ternary state system of magnetic fields, the bit adapted to be covered by a slidable plate and provided with structure for holding the plate to the bit; and a lock comprising structure for receiving the key, at least one magnetic sensor disposed in juxtaposition in the key receiving structure to the at least one key recess in the key bit when the key is inserted in the key receiving structure, the at least one magnetic sensor detecting a particular state of the ternary magnetic field state system and outputting a corresponding signal to the codifier circuit.

2. The improvement according to claim 1 further comprising a switch connected to the codifier circuit and disposed in relation to the key receiving structure so that the switch is actuated when the key is fully in the key receiving structure, the codifier circuit enabled to receive the corresponding signal of the at least one sensor when the switch is actuated.

3. The improvement according to the claim 1, wherein the key receiving structure is a plane comprising at least one sensor for detecting the ternary magnetic field state system.

4. The improvement according to claim 1, wherein one magnetized disk is fixed in a bit recess and one magnetic sensor, disposed in juxtaposition with the one fixed magnetized disk when the key is inserted in the key receiving structure, enabling of the codifier circuit to receive the corresponding signal of the at least one sensor.

5. The improvement according to claim 1 wherein the key receiving structure is a slot.

6. A key for use with a magnetic locking system comprising:

a bit with a plurality of recesses, the recesses oriented transversely to the to the longitudinal axis of the key, at least one removable magnetized disk disposed in the recesses, the magnetic field of the at least one magnetized disk oriented in either direction along the axis of the recesses, the two magnetic polarities of the disk magnetic field in combination with no magnetic field of an empty recess forming a ternary state system of magnetic fields, and a plate covering the bit for containing the at least one disk in the recesses, the plate being removable for changing the orientation of the magnetic field of the at least one disk or for changing the location of the at least one disk with respect to the recesses.

7. The key according to claim 6 wherein the plate is slideably removable from the bit.

8. The key according to claim 7 wherein the plate provides structure for holding the plate to the bit.

9. A lock for use with a magnetic key, the magnetic key having a means for holding at least one magnetic structure having a magnetic field oriented tranversely to the longitudinal axis of the key, the at least one magnetic field forming of a ternary state system of magnetic fields, the ternary state system comprising a magnetic field of either polarity or the absence of a magnetic field, the lock comprising:

a body, a structure disposed in the body adapted for receiving the key, at least one sensor disposed adjacent to the key receiving structure for detecting a state of the ternary system of magnetic fields and outputting a corresponding signal.

10. The lock according to claim 9 wherein the structure for receiving the key is a slot.

11. The lock according to claim 10 wherein the at least one sensor is disposed in juxtaposition with respect to the at least one magnetic structure of the key when the key is fully received by the key receiving structure.

* * * * *